United States Patent [19]

Smith

[11] 4,267,849

[45] May 19, 1981

[54] CIGARETTE HOLDER

[76] Inventor: Ernest A. Smith, 757 NW. Coast St., Newport, Oreg. 97365

[21] Appl. No.: 57,737

[22] Filed: Jul. 16, 1979

[51] Int. Cl.[3] ..... A24F 3/02; A24F 13/02; A24F 9/04

[52] U.S. Cl. ..... 131/84 R; 131/187; 131/202

[58] Field of Search ..... 131/187, 184 R, 184 B, 131/202, 203, 198, 178, 182, 243, 245, 261 B

[56] References Cited

U.S. PATENT DOCUMENTS

| | | | |
|---|---|---|---|
| 1,147,527 | 7/1915 | Matacotta | 131/207 |
| 1,319,358 | 10/1919 | Raje | 131/182 |
| 1,554,353 | 9/1925 | Johnson | 131/182 |
| 2,151,002 | 3/1939 | Ashley | 131/202 |
| 2,171,770 | 9/1939 | Strauch | 131/11 |
| 2,228,951 | 1/1941 | Franklin | 131/187 |
| 2,319,756 | 5/1943 | Swan | 131/202 |
| 2,378,175 | 6/1945 | Benedict | 131/202 |
| 2,546,237 | 3/1951 | Reafeld | 131/184 R |
| 2,770,240 | 11/1956 | Stauber | 131/203 |
| 2,910,987 | 11/1959 | Ross | 131/208 |
| 2,911,984 | 11/1959 | Gerard et al. | 131/267 |
| 3,021,849 | 2/1962 | Alles | 131/182 |
| 3,097,655 | 7/1963 | Oden | 131/184 R X |
| 3,303,850 | 2/1967 | Parrigin | 131/182 |
| 3,460,544 | 8/1969 | Doppelt | 131/198 |
| 3,577,996 | 5/1970 | Sherrill | 131/10.5 |
| 3,669,128 | 6/1972 | Cohen | 131/261 B |
| 3,771,534 | 11/1973 | Kuehne | 131/187 |
| 3,777,765 | 12/1973 | Yoshinaga | 131/187 |
| 3,796,223 | 3/1974 | Tarrant | 131/182 |
| 3,805,808 | 4/1974 | Yoshinaga | 131/182 |
| 3,946,748 | 3/1976 | Frankfurt | 131/261 R |

*Primary Examiner*—Stephen C. Pellegrino

*Attorney, Agent, or Firm*—Klarquist, Sparkman, Campbell, Leigh, Whinston & Dellett

[57] ABSTRACT

A cigarette holder includes a pair of compartments for receiving filtering material, the holder being joined in the middle by a sleeve carrying a retrieving member having a hook on one end and a tamping handle at the opposite end. For taking the cigarette holder apart and replacing of filtering material, the sleeve is removed and is suitably utilized as a holding handle with respect to which the retrieving member is extended in a first direction for retrieving cotton material, and extended in the reverse direction to provide a tamping end for forcing new cotton material into the cigarette holder.

13 Claims, 11 Drawing Figures

FIG. 1
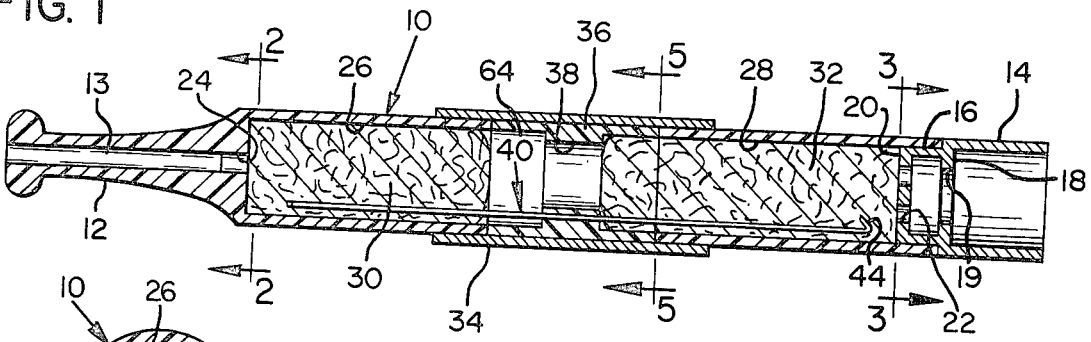
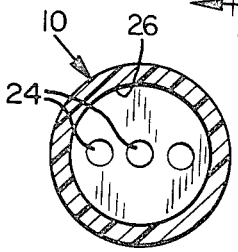
FIG. 2
FIG. 3
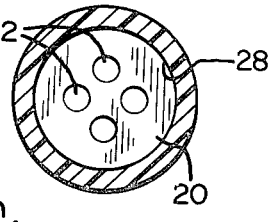
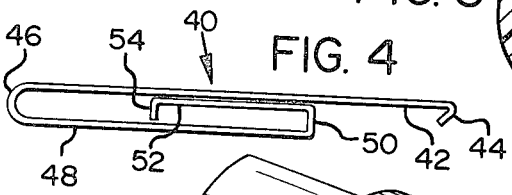
FIG. 4
FIG. 5
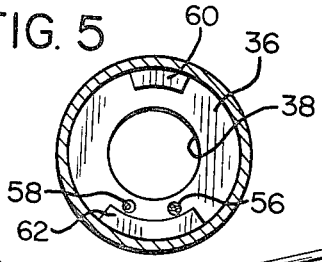
FIG. 6
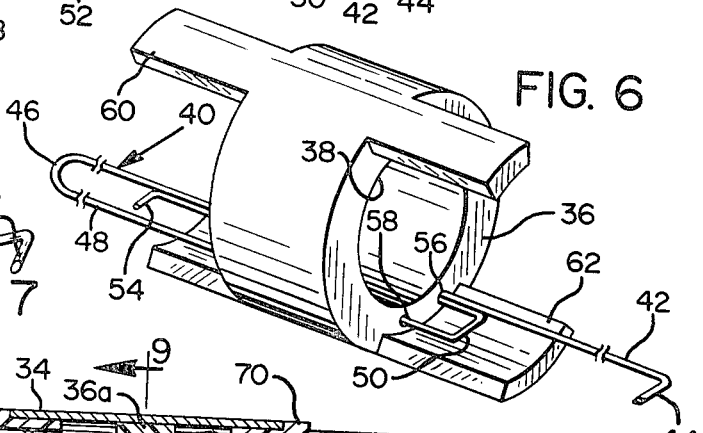
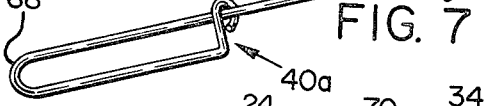
FIG. 7
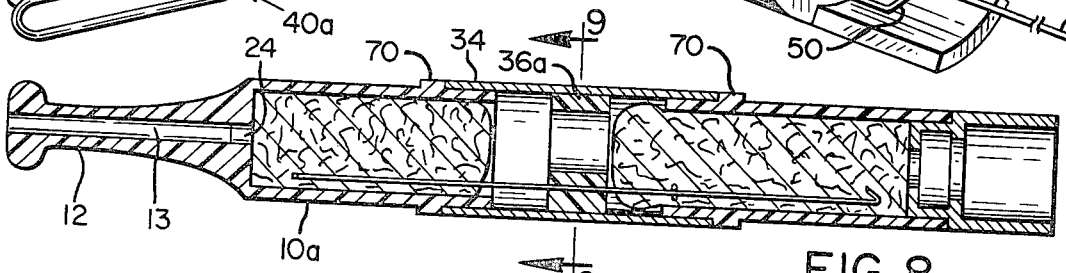
FIG. 8
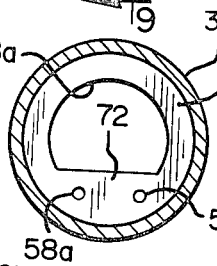
FIG. 9
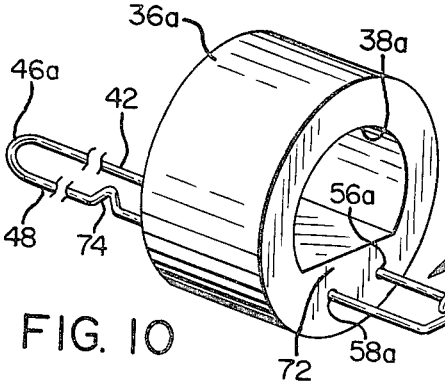
FIG. 10
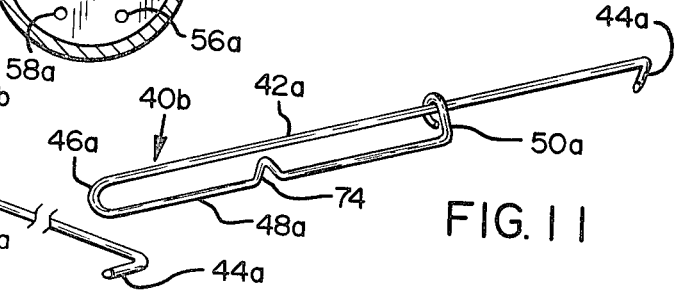
FIG. 11

CIGARETTE HOLDER

BACKGROUND OF THE INVENTION

The present invention relates to a cigarette holder and particularly to a cigarette holder provided with improved self-contained means for retrieving and replacing filtering material.

Cigarette holders are commonly manufactured to include some kind of filtering device to remove a portion of the tar and nicotine before it reaches the smoker. Some holders are designed to be discarded after a period of use and others are adapted to receive replaceable filtering elements comprising either loose cotton or replaceable factory-made filtering elements. Unfortunately, discardable holders can represent an inordinate expense, and similarly, replaceable manufactured filter elements may also be undesired from the standpoint of cost. Quite satisfactory filtering can be accomplished with readily available absorbent cotton, but removal and replacement of used cotton wadding from a cigarette holder is frequently inconvenient and untidy. While mechanisms have been proposed heretofore for removing or ejecting filtering material, they pertain mainly to factory-made filtering elements which can be removed or ejected as a unit. Moreover, no means is provided for inserting loose cotton material into the cigarette holder as a replacement filtering medium.

SUMMARY OF THE INVENTION

In accordance with the present invention, a cigarette holder includes an elongated hollow tubular shell having a mouthpiece at one end and a cigarette holding member at the other. The tubular shell carries filtering material and a retrieving member comprising a hook at one end and a tamping handle at the other. The retrieving member preferably is formed from a stiff elongated wire reversely bent at a first end to provide the configuration of a hook and including a loop at the remaining end for tamping filtering material into the bore of the tubular shell.

The tubular shell in a preferred embodiment includes a separable sleeve supporting therewithin a retrieving member holder desirably taking the form of an annular ring which is perforate at one edge to slidably receive the retrieving member. In replacing filtering material, the sleeve is removed from the remainder of the tubular shell and employed as a holding handle, while the retrieving member is extended in a first direction for hooking the filtering material inside the tubular shell and removing the same. The retrieving member can then be extended in the opposite direction for tamping new filtering material within the tubular shell prior to reassembly of the cigarette holder. During use, the aforementioned sleeve stores the retrieving member along one side thereof and within the tubular shell between the filtering material and the inside wall of the tubular shell.

It is accordingly an object of the present invention to provide an improved cigarette holder containing a filtering medium.

It is another object of the present invention to provide an improved cigarette holder adapted to receive a replaceable filtering element, including means for conveniently inserting and removing such filtering element.

It is another object of the present invention to provide an improved cigarette holder adapted to employ either factory-made or loose cotton filtering elements.

It is a further object of the present invention to provide an improved cigarette holder adapted for convenient disassembly for removal and insertion of filtering element material.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a longitudinal cross-sectional view of a cigarette holder according to a first embodiment of the present invention;

FIG. 2 is a transverse cross-section taken at 2—2 in FIG. 1;

FIG. 3 is a transverse cross-section taken at 3—3 in FIG. 1;

FIG. 4 is a side view of a filter material retrieving member according to a first embodiment of the present invention;

FIG. 5 is a transverse cross-section of a cigarette holder according to the present invention taken at 5—5 in FIG. 1 and illustrating positioning of the FIG. 4 retrieving member through a ring contained in a sleeve centrally joining the aforementioned cigarette holder;

FIG. 6 is a perspective view of the aforesaid ring holding a retrieving member;

FIG. 7 is a side view of a retrieving member according to an alternative embodiment of the present invention;

FIG. 8 is a longitudinal cross-sectional view of a cigarette holder according to a third embodiment of the present invention;

FIG. 9 is an end view of a ring contained in a sleeve centrally joining the cigarette holder of FIG. 8;

FIG. 10 is a perspective view of the aforesaid ring holding a retrieving member; and FIG. 11 is a side view of a filter material retrieving member according to a preferred embodiment of the present invention.

DETAILED DESCRIPTION

Referring to the drawings and particularly to FIGS. 1 through 6, a cigarette holder according to a first embodiment of the present invention comprises an elongated tubular shell suitably formed of plastic material including a mouthpiece 12 integrally formed at one end and a metal ferrule 14 positioned at the opposite end for receiving the end of a cigarette. The mouthpiece has an interior passage 13 communicating with the interior of tubular shell 10. Metal ferrule 14 includes a smaller diameter extension 16 received within the tubular shell and separated from the remainder of the ferrule by a wall 18 having an aperture 19 for passing smoke. The extension 16 includes an end wall 20 suitably provided with small apertures 22, e.g. each having a diameter of about 1/16" for permitting the passage of smoke into the interior of the tubular shell while holding filtering material and a retrieving member (hereinafter described) therewithin. Similarly, the cross-section of FIG. 2 illustrates apertures 24, suitably having a diameter of about 1/16", for holding the filtering material and a retrieving member away from the mouthpiece. Alternatively, larger openings may be provided.

The tubular shell 10 has a relatively large longitudinal bore defining therewithin a first compartment 26 and a second compartment 28 through which cigarette smoke passes and respectively receiving filtering material 30 and 32. The plastic material from which the cigarette holder is formed is desirably translucent or transparent whereby the smoker can observe the tar accumulated within the filtering material which may act as a deterrent to continued smoking as well as giving an indication of the need for replacing filtering material. The compartments are joined in the middle of the cigarette holder by a cylindrical metal sleeve 34 adapted to slide over the exterior of the tubular shell portions for removably joining the same together. Secured within the metal sleeve 34 is a ring 36, suitably formed of plastic material, having a large internal bore or opening 38 for the passage of smoke and functioning as a holder for a filter material retrieving member 40.

Referring particularly to FIG. 4, the retrieving member 40 is formed of stiff stainless steel wire having a diameter of approximately 0.024 inches, and in the given example is formed from stiff fish leader wire manufactured by the Malin Company, Brook Park, Ohio. The retrieving member 40 includes a first straight portion 42 reversely bent at one end to provide a hook 44 adapted to retrieve filtering material. The wire is looped at the second end 46 to provide a handle useful in tamping filtering material within shell 10, and the wire is doubled back at 48 extending to a second loop or abutment 50 toward but short of the hook end of the device. From loop 50, a third portion 52 of the wire extends back along the first portion 42 ending in a transverse abutment 54 toward but short of second end 46.

The retrieving member of FIG. 4 is slidably received in perforations 56 and 58 (as seen in FIG. 5) in ring 36, with the first and third portions of the wire extending through perforation 56, while the second or doubled back portion 48 extends through perforation 58. As can be seen in FIG. 1, these perforations extend longitudinally through ring 36 and are adapted to support the retrieving member 40 for slidable movement along the edge of the sleeve 34 adjacent shell 10, i.e. substantially along the outside edge of filtering material 30 and 32 received within the respective compartments. The retrieving member 40 is received through the perforations in ring 36 such that loop 50 is located on one side of the ring 34 while abutment 54 is located on the opposite side (See FIG. 6.) The retrieving member is slidable through the perforations with respect to the ring between the limits determined by loop 50 and abutment 54. In use, the hook end of the retrieving member 40 is slidably extended for retrieving filtering material, and the opposite end is extended for tamping a new load of filtering material, while in either case the sleeve 34 is employed as a holding handle for the device.

As hereinbefore indicated, the sleeve 34 is telescopingly received externally over the portion of the tubular shell 10 defining compartment 26 and the portion of tubular shell 10 defining compartment 28, and the cigarette holder is disassembled for replacing filtering material by slidably removing the sleeve 34 from one or both portions of the tubular shell. In order to position the two portions of the tubular shell properly when the cigarette holder is assembled, the ring 36 secured within sleeve 34 may be provided with longitudinal extensions 60 and 62 near the periphery thereof on diametrically opposite sides of the ring. These extensions form abutments for the positioning of the shell relative to the ring and sleeve 34. One of the extensions, i.e., extension 62 as illustrated in FIG. 6, is suitably adjacent the perforations slidably receiving the retrieving member 40 and helps avoid accidental bending of the retrieving member.

Although sterile absorbent cotton is preferred as a filtering material, a factory-made filter element or elements can alternatively be employed. In the illustration of FIG. 1, filtering material 30 comprises sterile absorbent cotton which has been tamped into the first compartment 26 and will normally be tamped completely within such compartment leaving an air space 64 within sleeve 34 when the unit is assembled. However, the filtering material can also extend outwardly from the end of a compartment as illustrated for filtering material 32 extending from the end of compartment 28 toward ring 36. Factory-made filtering elements will generally require this additional length, and inasmuch as the same will protrude from the end of the compartment when the cigarette holder is disassembled, the filter element can be grasped between the fingers for removal. Clearly such a filter element can alternatively be removed with the hook end 44 of retrieving member 40.

Reviewing the utilization of the cigarette holder according to the present invention, the same is disassembled in the middle by sliding one or both ends of shell 10 out of sleeve 34 exposing the compartments for receiving the filtering material. The sleeve 34 is desirably removed from both portions of tubular shell 10 and employed as a holding handle for the retrieving member 40. Retrieving member 40 is extended in the direction of hook 44, as by finger pressure on handle end 46, such that the hook 44 can extend a maximum convenient distance. Member 40 is then employed as a retrieval tool by inserting the hook along the side of the tubular shell, and turning and withdrawing the same to remove the filtering material.

If the compartment in which hook 44 was normally positioned before disassembling contained filtering material, then removal of sleeve 34 from such compartment will tend to remove the filtering material at the same time. Then the retrieving member 40 is employed in the above described manner to remove the filtering material from the remaining compartment.

New filtering material, preferably in the form of sterile absorbent cotton, is placed in both compartments 26 and 28 and is tamped in place employing handle end 46. For the purpose of extending the handle end, the hook end may be tapped upon a surface for sliding the handle end 46 outwardly from sleeve 34, or alternatively the handle end may be grasped by the fingers and pulled out. The retrieving member 40 is then slidably moved to extend approximately symmetrically on either side of ring 36, and the cigarette holder is reassembled by sliding the separated portions of tubular shell 10 into sleeve 34 until they abut extensions 60 and 62 of ring 36.

Although the first embodiment according to the present invention is preferred thereover because of the convenience in handling retrieving member 40, an alternative version may be employed including a retrieving member as illustrated in FIG. 7. Retrieving member **40*a* is also formed of stiff wire and includes a hook end 66 for retrieving filtering material and a looped end 68 for providing a tamping handle. This retrieving member can be slid along the interior of the cigarette holder between the filtering material and the inside wall of the tubular shell. In such case, a ring 36 is not required inside sleeve 34**.

A third and preferred embodiment according to the present invention is illustrated in FIGS. 8 through 11. This embodiment is quite similar to the embodiment of FIGS. 1 through 6, and corresponding reference numerals are employed. As can be seen from FIG. 8, illustrating in cross section the holder according to the third embodiment, tubular shell 10*a* is exteriorly provided with annular shoulders 70 adjacent either end of metal sleeve 34. One such shoulder is located on each of the separable portions of shell 10*a*, a short distance from the separable open end thereof, for positioning sleeve 34. The ring 36*a* is secured centrally inside the sleeve 34 but the extensions 60 and 62 of the first embodiment are not included. As can be seen in FIG. 9 and FIG. 10, the ring 36*a* is provided with a bolstered segment 72 having perforations 56*a* and 58*a* extending longitudinally therethrough for receiving a retrieving member.

FIG. 11 illustrates an alternative form of retrieving member, 40*b*. This retrieving member, which is also formed of stiff wire, includes a first straight portion 42*a* reversely bent at one end to provide a hook 44*a* adapted to retrieve filtering material. The wire is looped at the second end 46*a* to provide a handle useful in tamping filtering material within shell 10*a* (or 10), and the wire is doubled back at 48*a* extending to a transverse abutment 50*a* toward but short of the hook end of the device. The abutment 50*a* is suitably looped around the first straight portion 42*a*. The abutment 50*a* forms a first stop for limiting longitudinal sliding movement of the retrieving member relative to the ring 36*a* (or 36). To limit slidable movement in the opposite direction, the doubled back portion 48*a* is indented at 74 toward first portion 42*a*. The embodiment of the retrieving member according to FIG. 11 is somewhat easier to manufacture and install than the member of FIG. 4, and is therefore preferred for either of the cigarette holders described herein.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A cigarette holder comprising:

an elongated hollow tubular shell adapted to receive filtering material therewithin, said tubular shell having a mouthpiece at one end provided with an interior passage communicating with the interior of said shell and a cigarette holding member at the other end having an opening communicating with the interior of said shell, said tubular shell having an internal longitudinal bore for receiving said filtering material through which smoke must pass from said cigarette holding member to said mouthpiece, said cigarette holder being separable to provide access to the interior of said bore for inserting and withdrawing filtering material, and a retrieving member adapted to be carried within said holder for urging filtering material within said bore and retrieving filtering material from said bore, said retrieving member comprising an elongated wire adapted to be received along the side of said bore adjacent said filtering material and being reversely bent at one end to provide the configuration of a hook and including a handle at the remaining end for tamping filtering material into said bore, said handle being disposed generally in the plane of said elongated wire to fit along said bore said holder providing means for slidably receiving said retrieving member.

2. A cigarette holder comprising:

an elongated hollow tubular shell adapted to receive filtering material, said shell having a mouthpiece at one end provided with an interior passage communicating with the interior of said shell and a cigarette holding member at the other end having an opening communicating with the interior of said shell, said shell having an internal longitudinal bore for receiving said filtering material through which smoke must pass from said cigarette holding member to said mouthpiece, said cigarette holder being separable to provide access to the interior of said bore for inserting and withdrawing filtering material, and an elongated retrieving member for urging filtering material within said bore and retrieving filtering material from said bore, said retrieving member including a hook at one end and a tamping handle at the other, said tubular shell including a separable sleeve supporting therewithin a retrieving member holder carrying said retrieving member and confining said retrieving member to slidable movement adjacent the interior of said sleeve, adapting said retrieving member for extension along said sleeve for use in retrieval of filtering material upon removal of said sleeve from said tubular shell.

3. The cigarette holder according to claim 2 wherein said retrieving member holder comprises an annular ring and said retrieving member comprises a wire hook, said annular ring being centrally apertured to permit the passage of smoke, and having a perforation adjacent said sleeve and extending longitudinally through said ring for slidably receiving said retrieving member therethrough.

4. The cigarette holder according to claim 2 wherein said retrieving member is comprised of a stiff wire having a first portion with said hook at one end and being looped at the second end to provide said handle, said wire being doubled back toward said hook and extending to the opposite side of said retrieving member holder from said handle, said retrieving member holder comprising an annular ring having a central opening through which smoke passes, and a pair of perforations through said ring adjacent said sleeve for respectively receiving the first portion of said retrieving member between said hook and said handle, and the doubled back portion.

5. The cigarette holder according to claim 4 wherein the doubled back portion of said retrieving member forms a second loop on the remote side of said retrieving member holder from said handle and further extends toward said handle from said second loop forming a third portion passing through the same perforation in said ring as the first portion of said retrieving member, said third portion being bent transversely short of said handle to provide an abutment such that said retrieving member is slidable along said retrieving member holder as restricted by said second loop and said abutment encountering sides of said retrieving member holder.

6. The cigarette holder according to claim 4 wherein said doubled back portion of said retrieving member is bent to form a transverse abutment on the remote side of said retrieving member holder from said handle, and wherein said doubled back portion is indented toward said first portion on the same side of said retrieving member holder as said handle to provide restriction in slidable movement of said retrieving member by said abutment and by the indentation.

7. The cigarette holder according to claim 6 wherein said sleeve is telescopingly received externally of said shell between the compartments thereof, and wherein said shell is provided with annular shoulders therearound to limit the slidable movement of said sleeve for positioning of said sleeve.

8. The cigarette holder according to claim 7 wherein said shoulders are located to position said sleeve to provide a region for filtering material extending within said sleeve from one or both of the shell compartments joined by said sleeve.

9. The cigarette holder according to claim 2 wherein said shell is separated into two filter receiving compartments and said sleeve joins said cigarette holder by slidable engagement with said shell between said compartments.

10. The cigarette holder according to claim 7 wherein said sleeve is telescopingly received externally of said shell between the compartments thereof, and wherein said retrieving member holder comprises a ring having longitudinal extensions disposed in abutting relation with the ends of the two shell compartments when said sleeve joins said cigarette holder together.

11. The cigarette holder according to claim 10 wherein said longitudinal extensions are peripheral of said ring and extend to provide a region for filtering material to extend within said sleeve from one or both of said compartments.

12. The cigarette holder according to claim 10 wherein one such extension is adjacent said retrieving member, said ring being longitudinally perforate to slidably receive said retrieving member.

13. The cigarette holder according to claim 2 further provided with a perforate wall adjacent said mouthpiece and adjacent said cigarette holding member for confining filter material and said retrieving member within said tubular shell.

* * * * *